US008202103B2

(12) United States Patent
Zhou et al.

(10) Patent No.: US 8,202,103 B2
(45) Date of Patent: Jun. 19, 2012

(54) ELECTRICAL CONNECTOR WITH EJECTOR

(75) Inventors: Bao-Shan Zhou, Kunshan (CN); Zhen-Sheng Wang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/980,436

(22) Filed: Dec. 29, 2010

(65) Prior Publication Data

US 2011/0159715 A1 Jun. 30, 2011

(30) Foreign Application Priority Data

Dec. 30, 2009 (CN) ..... 2009 1 0312650

(51) Int. Cl.
*H01R 13/62* (2006.01)

(52) U.S. Cl. ..... 439/159; 439/946

(58) Field of Classification Search ..... 439/152, 439/159, 377, 630, 946
See application file for complete search history.

(56) References Cited

U.S. PATENT DOCUMENTS 7,448,912 B1 * 11/2008 Shiue et al. ..... 439/630
7,465,197 B1 * 12/2008 Wu et al. ..... 439/630
7,819,678 B2 * 10/2010 Ye et al. ..... 439/159

FOREIGN PATENT DOCUMENTS

CN 2749135 12/2005

* cited by examiner

*Primary Examiner* — Khiem Nguyen
(74) *Attorney, Agent, or Firm* — Ming Chieh Chang; Wei Te Chung; Andrew C. Cheng

(57) ABSTRACT

An electrical connector (100) includes an insulative housing (1) having a base portion (11) and a tongue portion (12) extending forwardly from the base portion along a mating direction, a number of contacts (2) assembled in the insulative housing, and an ejector (4) comprising a slider (41), a pin member (43), and at least one spring element (42) for cooperatively ejecting a mating component. The slider has a rear lengthwise portion (411) extending along the mating direction and a front transverse portion (412) perpendicular to the mating direction. The lengthwise portion is moveably assembled on the base portion, and the transverse portion is positioned upon the tongue portion for being pushed by the mating component.

12 Claims, 5 Drawing Sheets

ELECTRICAL CONNECTOR WITH EJECTOR

BACKGROUND OF THE INVENTION

1. Field of the Invention

The present invention relates generally to an electrical connector, and more particularly to an electrical connector with an ejector for easily ejecting a mating component without increasing a lateral width thereof.

2. Description of Related Arts

Normally, a USB connector and an electrical card connector are respectively provided in an electronic product. The USB connector is assembled on a printed circuit board, and receives a mating USB plug for transmitting signals between the mating USB plug and the printed circuit board. The electrical card connector is separately assembled on the printed circuit board, and receives an electrical card for transmitting signals between the electrical card and the printed circuit board. The USB connector and the card connector are separated on the printed circuit board, which takes individual spaces of the printed circuit board. An electrical connector compatible for a USB plug and an electrical card is developed nowadays. Such compatible electrical connector is assembled on the printed circuit board and saves space of the printed circuit board for other components. The compatible electrical connector usually comprises an insulative housing, a plurality of contacts retained in the insulative housing, a metal shell covering the insulative housing, and an ejector for ejecting the insertion card. Because electronic products usually need several I/O connectors, space in width may be more important. However, the ejector is usually assembled at a side of the insulative housing, which takes additional widthwise space of the connector. Furthermore, the electrical connector usually has a small size and the ejector has a small size too. Ejection force on the card is small and there is a sideward component of the force acting on the ejector. The ejector assembled at the side of the insulative housing thereof may not steadily and effectively eject the card.

Hence, an electrical connector with an ejector for easily ejecting a mating component and also saving space in width is desired.

SUMMARY OF THE INVENTION

Accordingly, an object of the present invention is to provide an electrical connector with an ejector for easily ejecting a mating component and also saving space in width.

To achieve the above object, an electrical connector includes an insulative housing having a base portion and a tongue portion extending forwardly from the base portion along a mating direction, a number of contacts assembled in the insulative housing, and an ejector comprising a slider, a pin member, and at least one spring element for cooperatively ejecting a mating component. The slider has a rear lengthwise portion extending along the mating direction and a front transverse portion perpendicular to the mating direction. The lengthwise portion is moveably assembled on the base portion, and the transverse portion is positioned upon the tongue portion for being pushed by the mating component.

Other objects, advantages and novel features of the invention will become more apparent from the following detailed description when taken in conjunction with the accompanying drawings.

DETAILED DESCRIPTION OF THE PREFERRED EMBODIMENT

Figure 1:
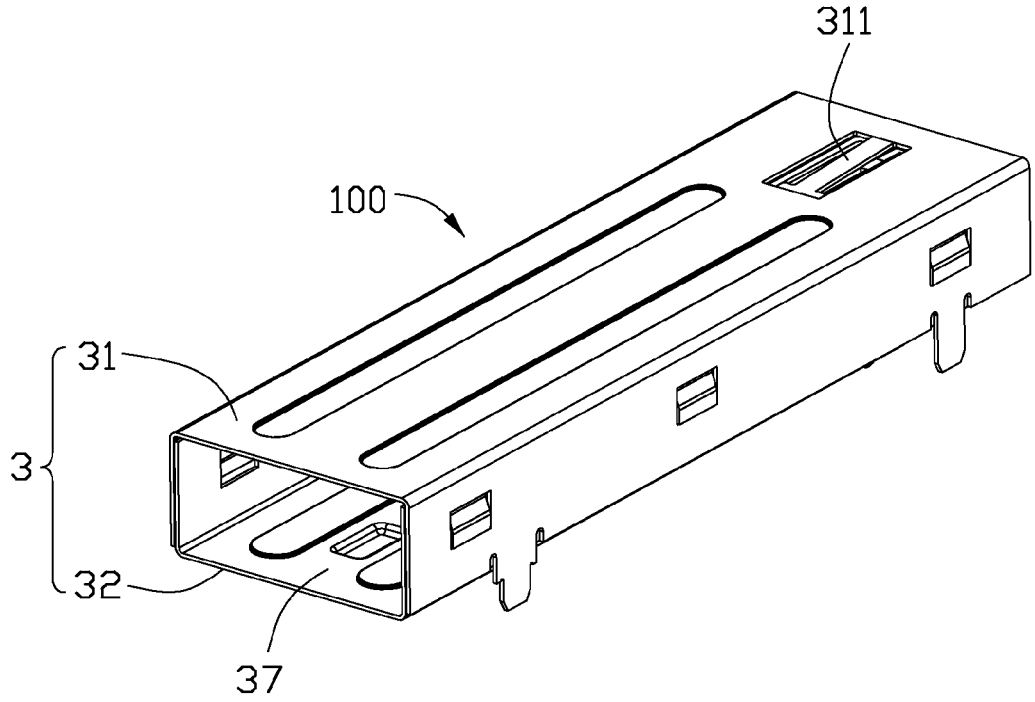
FIG. 1 is a perspective, assembled view of an electrical connector constructed in accordance with the present invention.
Figure 2:
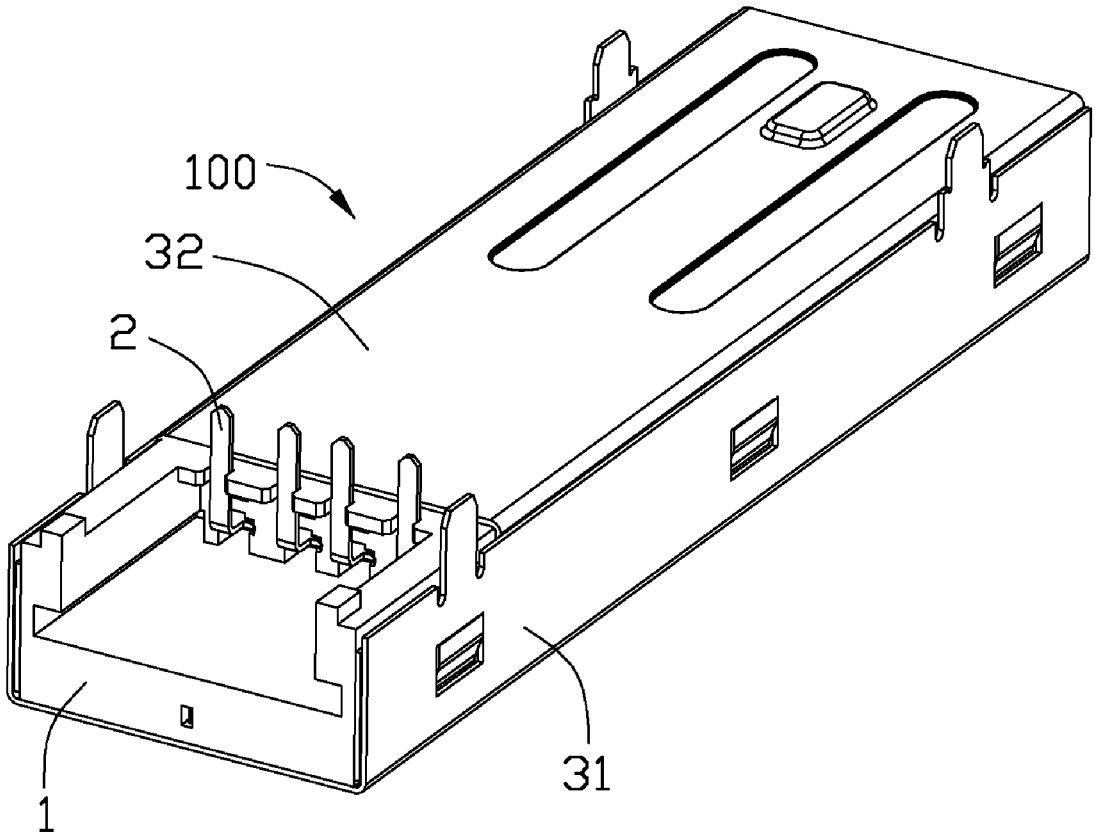
FIG. 2 is another perspective, assembled view of the electrical connector.

Reference will now be made in detail to the preferred embodiment of the present invention.

Referring to FIGS. 1-5, an electrical connector 100 in accordance with the present invention, used for receiving a mating component (not shown), comprises an insulative housing 1, a plurality of contacts 2 retained in the insulative housing 1, a metallic shell 3 covering the insulative housing 1, and an ejector 4 assembled at a rear part of the insulative housing 1. The mating component is either a mating plug (not shown) or an electrical card (not shown). The mating plug and the electrical card are inserted and mated with the contacts 2 through a same insertion port along a same direction, but the mating plug and the electrical card are separately inserted and prevented from being synchronously inserted.

Figure 3:
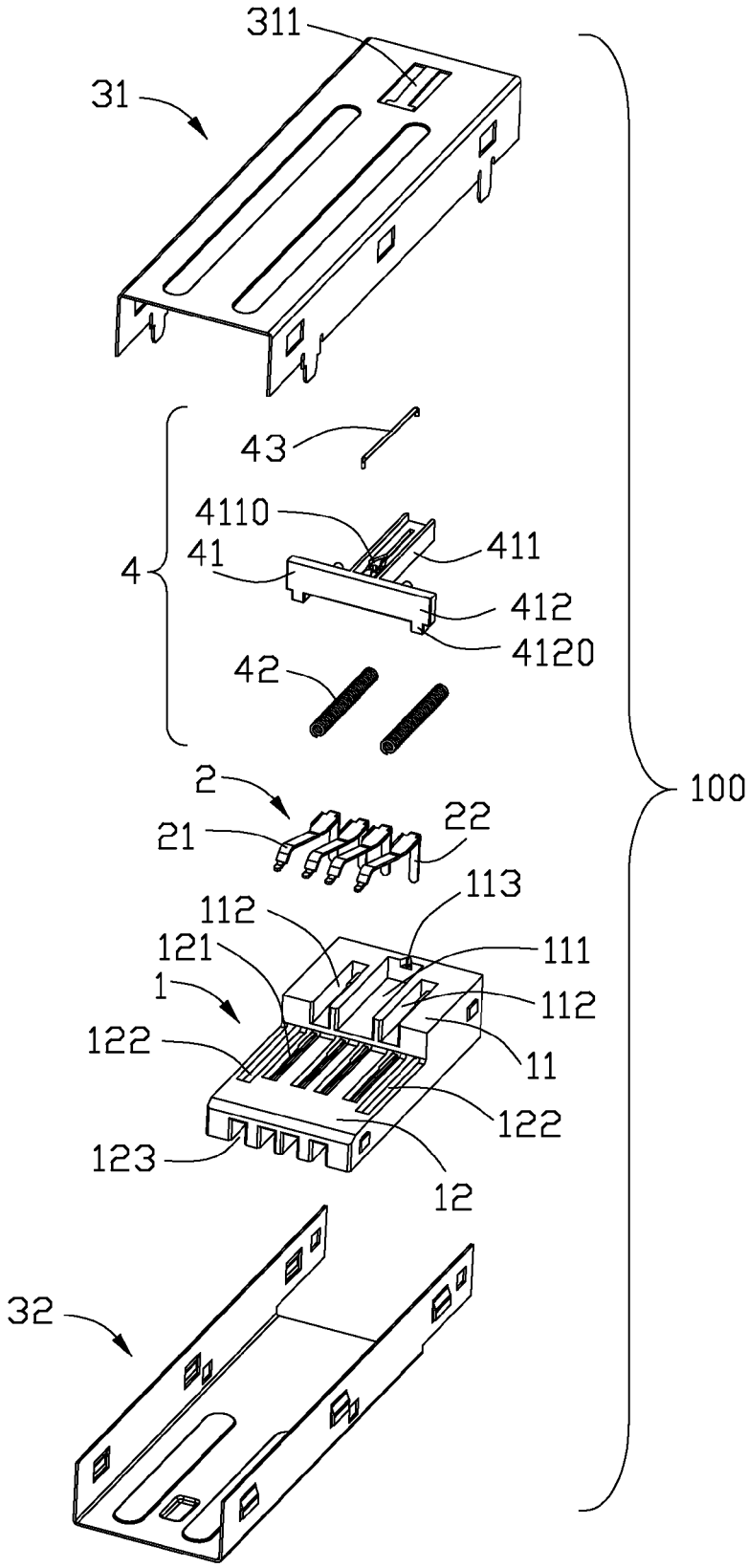
FIG. 3 is a perspective, fully exploded view of FIG. 1.

Referring to FIG. 3, the insulative housing 1 comprises a base portion 11 and a tongue portion 12 extending forwardly from the base portion 11. The tongue portion 12 defines a plurality of passageways 121 along the mating direction and a pair of slits 122 at two opposite sides of the passageways 121. The slits 122 also extend along the mating direction as the passageways 121 but extend longer than the passageways 121. The base portion 11 defines a groove 111 along the mating direction in the middle thereof and a pair of slots 112 at two opposite sides of the groove 111. The slots 112 also extend along the mating direction as the groove 111 but extend shorter than the groove 111. Taken along the mating direction, the base portion 11 defines an opening 113 at a rear part of the groove 111. An upper face of the tongue portion 12 is lower than that of the base portion 11 and a lower face of the tongue portion 12 is coplanar with that of the base portion 11, i.e. the tongue portion 12 has a thickness smaller than that of the base portion 11.

Referring to FIG. 3, the contacts 2 are received in the passageways 121 of the insulative housing 1 and each contact 2 comprises a contacting portion 21 extending above the upper face of the tongue portion 12 for connecting with the mating component, and a tail portion 22 extending downwardly from the contacting portion 21 and below the lower face of the insulative housing 1 for connecting to a printed circuit board (not shown). The contacts 2 are flexible and the contacting portions 21 are movable along a vertical direction perpendicular to the mating direction. The lower face of the tongue portion 12 defines a plurality of cavities 123 communicating with the passageways 121 in the vertical direction for providing the downward movement of the contacting portions 21.

Figure 4:
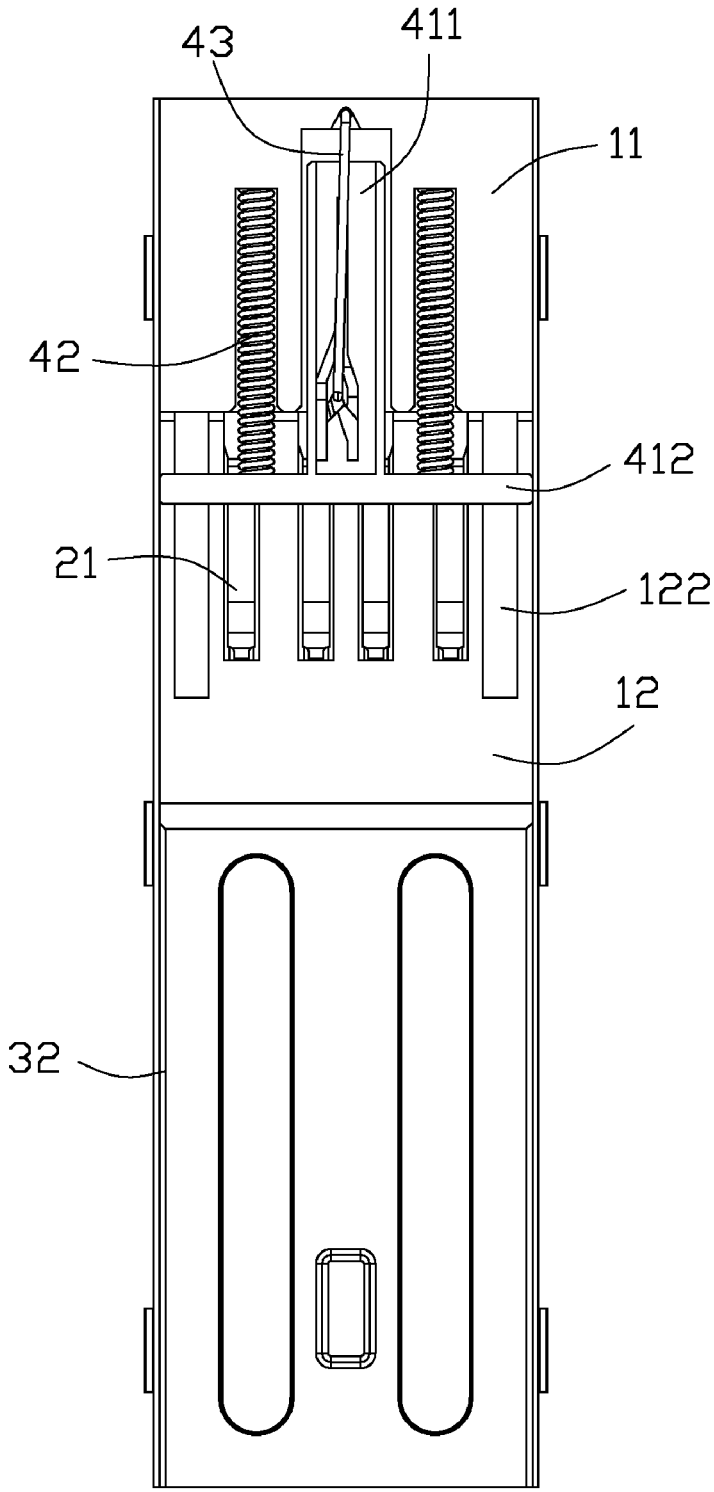
FIG. 4 is a top plan view of the electrical connector with a top cover is removed away for clarity.
Figure 5:
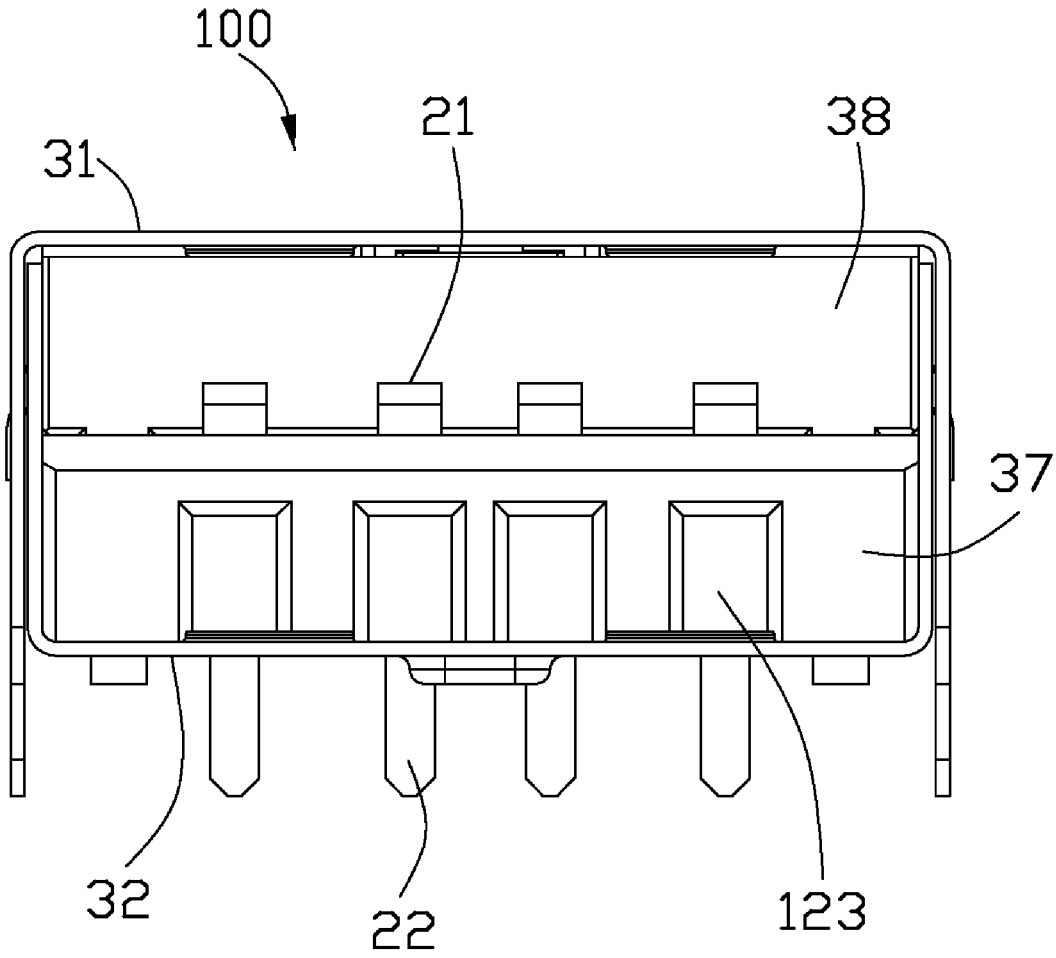
FIG. 5 is a front elevational view of the electrical connector.

Referring to FIGS. 3 and 4, the ejector 4 comprises a slider 41, a pin member 43 and two spring elements 42. The slider 41 comprises a lengthwise portion 411 extending along the mating direction and a transverse portion 412 extending perpendicular to the mating direction. The lengthwise portion 411 defines a heart-shaped slot 4110 therein for guiding the pin member 43. The transverse portion 412 forms a pair of protrusions 4120 downwardly therefrom. The lengthwise portion 411 is received in the groove 111 of the base portion 11 and the transverse portion 412 is positioned above the upper face of the tongue portion 12. The protrusions 4120 are received in the slits 122 of the tongue portion 12. As the slider 41 moves along the mating direction in response to insertion of the mating component, the protrusions 4120 move in the slits 122. During the movement of the protrusions 4120 in the slits 122, the transverse portion 412 moves across the contacting portions 21 due to elasticity of the contacting portions 21. The spring elements 42 are received in the slots 112 with one end thereof contacting with the base portion 11 and the other one end thereof contacting with the transverse portion 412, i.e., the spring elements 42 are compressed between the base portion 11 and the transverse portion 412 for providing elasticity. The pin member 43 has a first end (not labeled) retained in the opening 113 and a second end (not labeled) slideably moveable in the heart-shaped slot 4110. The principle of the heart-shaped slot 4110 of the ejector 4 is well-known to persons skilled in the art, and it is not described herein in detail. The spring elements 42 and the protrusions 4120 are both numbered in two in the preferred embodiment, it is just for providing balanced force but it is not limiting. In other embodiment, only one spring element 42 and one protrusion 4120 achieves the ejection of the mating component if adjusting the positions of the spring member 42 and the protrusion 4120.

Referring to FIGS. 1-4, the metallic shell 3 comprises a top cover 31 and a bottom cover 32 respectively located above and below the insulative housing 1. The top cover 31 has an elastic piece 311 elastically pressing down the pin member 43, preventing the pin member 43 from jumping out of the heart-shaped slot 4110 of the slider 41. The metallic shell 3 has a length commonly twice larger than that of the insulative housing 1 and accordingly, the mating component doesn't get to the insulative housing 1 until the mating component moves a rather distance along the mating direction. The top cover 31 and the bottom cover 32 of the metallic shell 3 cooperatively define a receiving space 38 for the mating component. An insertion port 37 is formed at the front of the receiving space 38.

When the mating component is inserted into the receiving space 38 and pushes the transverse portion 412 of the slider 41, the slider 41 moves rearward and presses against the spring elements 42 such that the spring elements 42 have elasticity. The pin member 43 is positioned at an inner position, and signals are transmitted between the mating component and the contacts 2. When a user pushes the mating component again, the pin member 43 moves away from the inner position and back to an outer position, elasticity of the spring elements 42 is released, and the mating component is ejected out of the electrical connector 100.

In the present invention, because the ejector 4 is assembled at a rear part of the insulative housing 1 taken along the mating direction, the ejector 4 takes inner room of the electronic product and saves spaces in width. The electrical connector 100 facilitates the electronic product for assembling more other I/O connectors. Furthermore, the mating component inserted in the electrical connector 100 is balancedly, easily ejected by the ejector 4.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising: an insulative housing having a base portion and a tongue portion extending forwardly from the base portion along a mating direction; a plurality of contacts assembled in the insulative housing; and an ejector comprising a slider, a pin member, and at least one spring element for cooperatively ejecting a mating component, the slider having a rear lengthwise portion extending along the mating direction and a front transverse portion perpendicular to the mating direction, the lengthwise portion moveably assembled on the base portion, the transverse portion positioned upon the tongue portion for being pushed by the mating component, wherein the base portion defines a groove receiving the lengthwise portion, wherein the ejector comprises two spring elements at two opposite sides of the lengthwise portion, and the base portion defines a pair of slots at two sides of the groove and receiving the spring elements, wherein the spring elements are compressed between the base portion and the transverse portion, wherein both the groove and the slots extend along the mating direction, wherein an opening is defined at a rear part of the groove along the mating direction, the lengthwise portion defines a heart-shaped slot, and the pin has a first end retained in the opening and a second end moveable in the heart-shaped slot.

2. The electrical connector as claimed in claim 1, wherein the contacts comprise a plurality of contacting portions extending above an upper face of the tongue portion and the transverse portion of the slider moves across the contacting portions during the insertion of the mating component.

3. The electrical connector as claimed in claim 2, wherein tongue portion defines a plurality of passageways receiving the contacts and a pair of slits at two sides of the passageways, and the transverse portion forms a pair of protrusions moveable in the slits.

4. The electrical connector as claimed in claim 3, wherein the slits extend longer than the passageways.

5. The electrical connector as claimed in claim 3, wherein the passageways and the slits extend along the mating direction.

6. The electrical connector as claimed in claim 1, further comprising a metallic shell with a top cover and a bottom cover cooperatively defining a receiving space for the mating component.

7. The electrical connector as claimed in claim 6, wherein the metallic shell has a length twice larger than that of the insulative housing.

8. An electrical connector comprising: an insulative housing including a base portion and a tongue portion extending forwardly from the base portion; a plurality of contacts disposed in the housing with resilient contacting sections deflectably exposed upon the base portion, said contacting sections commonly defining a USB interface configuration with contacting apexes thereof; and a metallic shell enclosing both the base portion and the tongue portion and defining a receiving space therein; and an ejector including a slider located on a centerline area of the housing and having a transverse portion which back and forth moves along the tongue portion in a front-to-back direction between front and rear positions, a spring set constantly urging the slider forwardly, and a heart-shaped slot structure cooperating with a pin member to limit back and forth movement of the slider in said front-to-back direction, wherein a stroke of the slider is essentially similar to a length of said tongue portion in said front-to-back direction, wherein the transverse portion is located in front of the contacting apexes when the transverse portion is located in the front position while exposing the contacting apexes when the transverse portion is located in the rear position, wherein the slider includes a lengthwise portion perpendicular to the transverse portion.

9. The electrical connector as claimed in claim 8, wherein said heart-shaped slot structure is formed on the lengthwise portion.

10. The electrical connector as claimed in claim 8, wherein said spring set includes two individual springs located by two sides of the lengthwise portion.

11. The electrical connector as claimed in claim 8, wherein the shell extends forwardly beyond the tongue portion.

12. An electrical connector for use with an electrical card, comprising: an insulative housing defining a rear base portion and a front tongue portion; a metallic shell enclosing said housing to define a receiving cavity in front of the base portion; a plurality of resilient contacts disposed in the housing with contacting sections exposed above the tongue portion; and an ejector having a slider back and forth moveable along a front-to-back direction between opposite front and rear positions, said slider defining a T-like configuration with a lengthwise portion mounted upon the base portion around a centerline area defined by a centerline, and a transverse portion linked to the lengthwise portion and structured for applying symmetric force to the electrical card relative to the centerline, a spring set constantly forwardly urging the slider and applying symmetric force upon the transverse portion relative to the centerline, and a heart-shaped slot structure is formed on the lengthwise portion and a pin member cooperatively controlling the slider to back and forth move in said front-to-back direction.

* * * * *